United States Patent [19]

Dreyer et al.

[11] Patent Number: 4,744,749

[45] Date of Patent: May 17, 1988

[54] PIPES HAVING ORIENTABLE NIPPLES FOR FURNACES FOR FIRING CARBONACEOUS BLOCKS

[75] Inventors: Christian Dreyer, St. Jean de Maurienne; Bernard Boffa, Lannemezan, both of France

[73] Assignee: Aluminium Pechiney, Paris, France

[21] Appl. No.: 60,258

[22] Filed: Jun. 10, 1987

[30] Foreign Application Priority Data

Jun. 17, 1986 [FR] France ..... 86 08988

[51] Int. Cl.[4] ..... F27B 9/00

[52] U.S. Cl. ..... 432/121; 432/152; 432/192; 432/196; 98/DIG. 7

[58] Field of Search ..... 432/17, 57, 121, 18, 432/144, 152, 188, 189, 196, 258, 192; 98/DIG. 7, 40.16

[56] References Cited

U.S. PATENT DOCUMENTS

| | | | |
|---|---|---|---|
| 2,775,927 | 1/1957 | Wulle | 98/DIG. 7 |
| 3,633,886 | 1/1972 | Froberg | 432/196 |
| 4,215,982 | 8/1980 | Genevois et al. | 432/152 |
| 4,253,823 | 3/1981 | Holdner | 432/192 |
| 4,310,301 | 1/1982 | Mayers et al. | 432/121 |
| 4,504,219 | 3/1985 | Thomas | 432/192 |
| 4,552,530 | 11/1985 | Gunnes et al. | 432/192 |
| 4,674,975 | 6/1987 | Corato et al. | 432/121 |

*Primary Examiner*—Henry C. Yuen

*Attorney, Agent, or Firm*—Dennison, Meserole, Pollack & Scheiner

[57] ABSTRACT

The invention concerns an improvement in a suction or blowing pipe for a furnace having partition chambers intended for the firing of carbonaceous blocks. The pipe comprises a main body (3) provided with a plurality of nozzles (10) to which tubular nipples (2) are connected in a number equal to the number or partitions (5) forming the chambers of the furnace. Each of the nipples is connected to a transverse furnace wall (9) or a partition (5) by a taphole (8) disposed in the upper part of the wall or partition. The improvement comprises forming each nipple by at least two tubular elements disposed in series, a first element (15) provided in its upper part (15A) with a first flat flange (18) adapted to cooperate in jointed relationship and in respect of rotation with a flat flange (19) located in the lower part of a nozzle (10), and in its lower part (15C) with a second flat flange (27) which is parallel to the first flat flange (18), and a second element (16) provided in its upper part (16A) with a third flat flange (26) which cooperates in jointed relationship and in respect of rotation with the second flange (27). The first and second elements have over at least part of their height an axis inclined by an angle $\alpha$ with respect to the axis 23 which is perpendicular to the plane of the flanges.

12 Claims, 4 Drawing Sheets

PIPES HAVING ORIENTABLE NIPPLES FOR FURNACES FOR FIRING CARBONACEOUS BLOCKS

TECHNICAL FIELD OF THE INVENTION

The invention concerns an improvement in the blowing and suction pipes of furnaces having open chambers, referred to as furnaces of the "rotary firing" (ring furnace) type or of the "forward-feed firing" type for the firing of carbonaceous blocks (anodes or cathodes) which are intended in particular for the tanks for the production of aluminium using the Hall-Heroult process, but also carbonaceous blocks of all types which are generally intended for electrometallurgy furnaces.

STATE OF THE ART

Hereinafter the expression "carbonaceous block" will be used to denote any product obtained by shaping a carbonaceous paste and intended after firing for use in electrometallurgical furnaces.

For example, carbonaceous anodes which are intended for tanks for the production of aluminium by means of the electrolysis of alumina dissolved in molten cryolite are produced by shaping a carbonaceous paste which results from working, at a temperature of around 120° to 200° C., a mixture consisting of crushed coke and pitch. After the shaping operation, the anodes are fired for about a hundred hours at a temperature of the order of 1100° to 1200° C. Other types of carbonaceous blocks are produced by means of the same process.

Although there are a number of processes for continuous firing in a tunnel furnace, a large number of the firing installations which are in operation throughout the world at this time are of the "chamber furnace" type, referred to as being of the "rotary firing" type (ring furnace type) or else of the "forward-feed firing" type. Those furnaces are themselves divided into two categories, closed furnaces and furnaces which are referred to as having "open chambers", as described in particular in U.S. Pat. No. 2,699,931 and which are the most widely used. The present invention is applied more particularly to furnaces having open chambers.

That type of furnace comprises two parallel banks or arrays whose total length may attain more than around a hundred metres.

Each bank or array comprises a succession of chambers which are separated by transverse walls and which are open in their upper part to permit charging thereof with the unfired blocks and removal of the fired blocks after cooling. Each chamber comprises, disposed in parallel relationship to the long axis of the furnace, an assembly of hollow partitions, formed with thin walls, in which the hot gases for effecting the firing operation will circulate, alternating with cavities in which the blocks to be fired are stacked, which blocks will then be buried in a carbonaceous dust (coke, anthracite or crushed carbonaceous residues or any other lining material in powder form). There are for example 6 cavities and 7 partitions in alternating relationship per chamber.

In their upper part, the hollow partitions are provided with closable openings referred to as "tapholes"; they further comprise baffle arrangements for increasing the length of and for uniformly distributing the path of flow of the combustion gases.

The furnace is heated by burner assemblies of a length equal to the width of the chambers and whose injectors are positioned on the tapholes of the chambers in question. Upstream of the burners (in relation to the direction of forward feed of the firing of the furnace), there is a pipe for blowing in combustion air while downstream there is a pipe for sucking away the burnt gases. Heating is effected both by the combustion of the injected fuel (gas or oil) and by combustion of the pitch vapours emitted by the blocks in the course of firing.

As firing occurs, the unit consisting of the blowing pipe, the burners and the suction pipes is advanced for example every 24 hours, each chamber thus successively performing the functions of charging with the unfired carbonaceous blocks, natural preheating (by virtue of the combustion gases), forced preheating and firing at 1100° to 1200° C. (the zone is referred to as full firing), cooling of the carbonaceous blocks (and preheating of the combustion gases), discharge of the fired carbonaceous blocks, any repair operations, and the resumption of a fresh cycle.

TECHNICAL PROBLEM TO BE SOLVED

One of the main problems involved in the operation of such furnaces having structures being continually subjected to cooling and heating cycles is the positioning of the blowing and suction pipes on the tapholes of the chambers. More specifically, in each step in the forward feed movement of the firing action, that is to say the assemblies of burners, the suction and blowing pipes have to be displaced by the same distance and in the same direction. It is important that each of the discharge portions of the pipes (often referred to as "nipples") is introduced into each of the corresponding tapholes without causing damage thereto and while providing a suitable seal, in particular as regards the suction pipe in order to prevent any undesirable intake of air. While that operation is relatively easy on a new furnace or on a renovated partition, it is much less easy in relation to a chamber which has been deformed to a greater or lesser degree by the thermal stresses involved and the operations of loading and removing the anodes. It not infrequently happens that it is necessary to carry out retouching and filling operations in order to provide a sealed joint between the nipples and the tapholes.

SUBJECT OF THE INVENTION

The subject of the invention is a pipe—which can operate both as a blowing pipe and as a suction pipe—in which each of the nipples is made orientable and adjustable in respect of height so that, at the moment of fitting it to a new chamber, each nipple can be easily and quickly oriented by a rotary movement in such a way that the axis of the lower part of each nipple coincides substantially with the axis of the corresponding opening and fits and connects to the taphole, with adjustment in respect of height by a sliding movement if necessary.

More precisely, the subject-matter of the invention is a pipe for a furnace having chambers which are intended for the firing of carbonaceous blocks for the production of aluminium, said pipe comprising a main body provided with a plurality of nozzles to which there are connected pipe portions referred to as "nipples", in a number equal to the number of lines of heating partitions forming the partitions of the chambers, each of which nipples has to adapt to the openings referred to as "tapholes" disposed in the upper part of each heating partition or the transverse walls separating the different chambers of the furnace.

According to the invention, each nipple is formed by at least two tubular elements which are disposed in series, a first element provided on the one hand in its upper part with a flat flange which co-operates in jointed relationship and in respect of rotation with a flat flange disposed at the lower part of the nozzle, and on the other hand, in its lower part, a flat flange co-operating in jointed relationship and in respect of rotation with a flat flange disposed in the upper part of the second element, the first and second elements having at least over a part of their height an axis which is inclined by an angle $\alpha$ with respect to the axis which is perpendicular to the plane of the flanges.

The flat flanges are parallel to each other and parallel to the plane containing the tapholes which is normally a horizontal plane.

In order to provide for adjustment in respect of height, each nipple further comprises a third tubular element which is in jointed relationship by partial sliding and coaxial interengagement with the lower part of the second element, the lower part of the third element fitting in sealed relationship to the taphole. Any defects in regard to horizontality are absorbed by the play at the location of the interengagement of the third tubular element.

Preferably, adjustment in respect of height is coupled with one of the adjustments in respect of rotary movement of the nipple by a link/crank system which simultaneously provides for rotation of the second element around the flange and sliding movement of its lower part.

DESCRIPTION OF THE PREFERRED EMBODIMENTS

Figure 1:
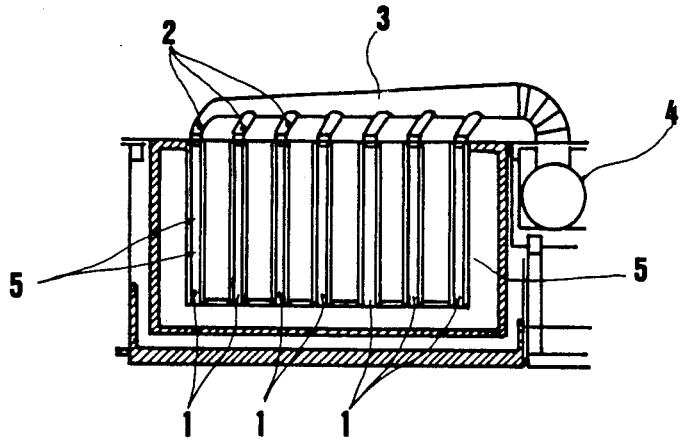
FIGS. 1 and 2 relate to the prior art and illustrate the conventional structure of a furnace with open chambers for firing carbonaceous anodes.
Figure 2:
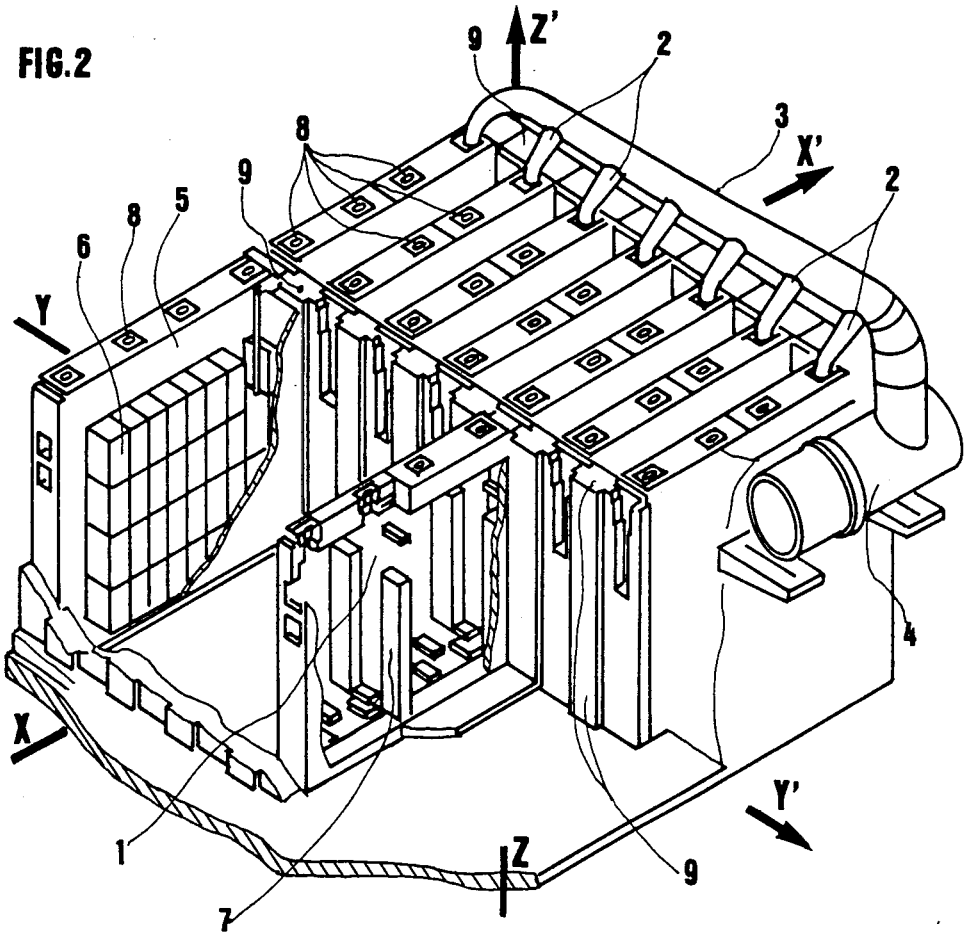

To assist with understanding the invention, FIGS. 1 and 2 illustrate the structure of a conventional chamber furnace to which the present invention is applied: referring to the section in FIG. 1, shown therein are the partitions 1 which are connected in their upper part by the "nipples" 2 to the pipe 3 which is itself connected to the general manifold 4. The blowing and suction pipes, depending on the circumstances involved, may be connected to the tapholes of the chambers or to the tapholes of the transverse walls 9, in accordance with our French Pat. No. 2 535 834. Disposed in the cavities 5 are carbonaceous blocks 6 which can be seen in the sectional view in the left-hand part of FIG. 2.

The baffle arrangements 7 of the heating partitions are intended to increase the length of the path of flow of the hot gases and to homogenize the temperature in the partition.

In the upper part of the chambers (or the transverse walls), the closable tapholes 8 permit positioning of the burner assemblies (not shown), the air suction and blowing pipes 3 and, in certain cases, measuring apparatuses (thermocouples and vacuum gauges). The successive chambers are separated by transverse walls 9. The long axis of the furnace is indicated by the line XX'.

Each nipple 2 of the suction pipe 3 is connected to a taphole 8 of a given chamber, in sealing relationship therewith. The upper part of the nipple is connected to the pipe 3 by a nozzle 10 in which there is generally disposed a movable butterfly flap 11 which, by rotation thereof about an axis 11A, makes it possible to control the flow rate in each series of chambers 5.

According to the invention, the vertical part of the nipple which engages into the taphole is made orientable in such a way that the axis 12 of the lower part substantially coincides with the axis 13 of the taphole in question.

In practice, the orientable nipple 14 according to the invention makes it possible to absorb a difference of $\pm 50$ mm in respect of eccentricity (axes X and Y) and a difference of $\pm 50$ mm in height (axis Z), those figures being given by way of example and not constituting a limitation on the invention.

In order to achieve alignment in X and Y, that is to say along the long axis XX' and along the transverse axis of the furnace (Y, Y'), the orientable nipple 14 is made up of at least two elements, on the one hand an upper element 15 which is connected to the nozzle, a straight part 10 which is itself connected to the pipe 3, and, on the other hand, an intermediate element 16, for adjustments in X and Y. A lower element 17 which is connected to the taphole 8 provides for adjustment along Z (height).

The upper element 15 itself comprises three parts:

(a) A top cylindrical part 15A provided with a flange 18 co-operating with the flange 19 of the nozzle (straight part) 10. The two flanges are in sealing relationship and the element 15 can perform a rotary movement with respect to the flange 19. The flange 18 is clamped against the flange 19 by a bolted counter-flange member 20. It is possible to interpose between the flanges 18 and 19 a sealing gasket which is capable of withstanding elevated temperatures (500° to 600° C.) for example of the metalloplastic type (copper + mineral fibres); it may also be formed by a simple packing of high temperature grease which is injected into the free space between the flanges 18 and 19 by a greaser 21. The top part 15A and the straight part of the nozzle 10 are coaxial.

(b) A central cylindrical part 15B whose axis 24 is inclined at an angle $\alpha 1$ of for example 20° to 45° with respect to the axis 23 of the top part (the above-indicated value of 20° to 45° does not constitute a limitation of the invention but is given by way of indication).

(c) A bottom cylindrical part 15C whose axis 25 is parallel to the axis 23 of the top part but is displaced by a distance equal to the maximum assumed difference between the axis 13 of the taphole and the axis 23 of the nozzle 10. It has been indicated hereinbefore that the probable maximum value could be fixed for example at 50 mm.

In the same manner as the upper part 15, the intermediate element 16 comprises:

(a) A top cylindrical part 16A provided with a flange 26 which co-operates with the flange 27 of the bottom part 15C of the upper element 15, (b) A central cylindrical part 16B with an axis 24A inclined at an angle $\alpha 2$ which in principle is equal to the angle α1 (or of the same order of magnitude) with respect to the axis 25.

(c) A lower cylindrical part 16C whose axis 28 is displaced with respect to the axis 25 by a distance equal to the maximum difference to be corrected, as indicated above, for example 50 mm.

The co-operation in jointed relationship and in respect of rotation between the intermediate element 16 and the upper element 15 is provided by the same means as at the location of the connection between the element 15 and the nozzle 10. Likewise the two flanges 27 and 26 which are fixed to each other by bolts may receive a sealing gasket, for example a metalloplastic gasket, or a stuffing of high temperature grease which is injected by way of the greaser 21.

Compensation for offset on the axis Z (that is to say along the vertical axis ZZ' of the furnace) (FIG. 2) is effected by means of the lower element 17 which fits to the taphole 8 in sealing relationship therewith.

Figure 3:
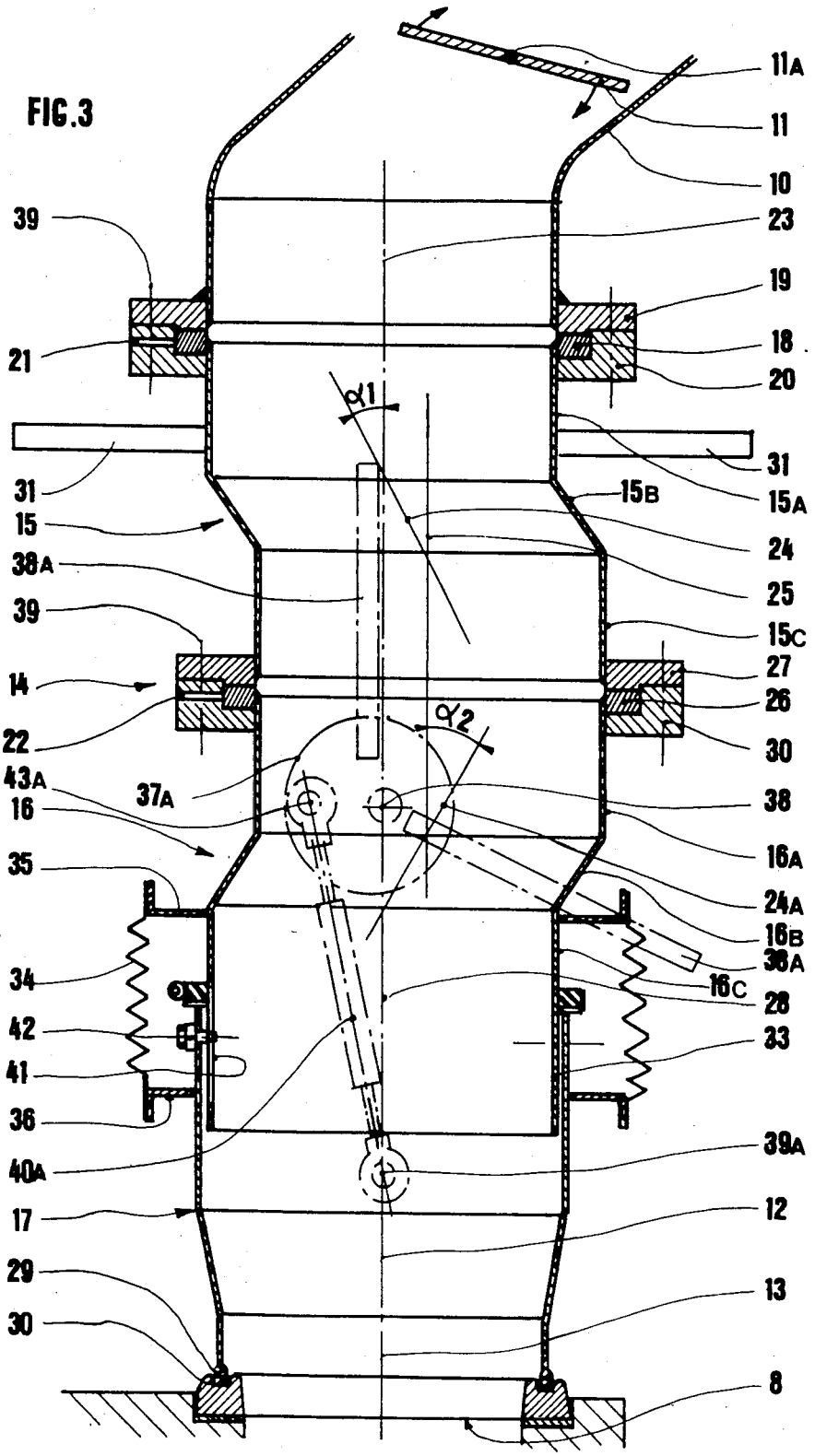
FIG. 3 is a view in cross-section of a nipple which is orientable and adjustable along the axes X, Y and Z according to the invention; the control system consisting of handles and struts which is in front of the sectional plane is shown in broken lines.

In the construction illustrated by way of example in FIG. 3, in the lower part, the lower element 17 is supported on a groove 30 at the periphery of the taphole. The groove may comprise a sealing gasket 29 which is resistant to elevated temperatures, being for example of felted or plaited mineral fibre. In addition the element 17 may be fastened by means of ties, the lower part of which is sealed in the masonry of the furnace. It will be noted that in FIG. 6, the element 17 is supported on a raised peripheral portion 32 of the taphole 8 by way of a double flexible joint 43.

The intermediate element 16 and the lower element 17 co-operate by way of a coupling configuration as indicated at 33 which makes it possible to compensate for a difference in level (dimension Z) between the mouth of the taphole and the lower part of the orientable nipple 14.

With regard to thermal expansion phenomena and the possible defects in respect of planarity of the tapholes, it would be difficult to provide a sliding coupling configuration which gives a perfect sealing effect. The sealing effect can be achieved by means of a flexible connection such as the bellows 34 which is fixed to the groove 35 in its upper part and to the groove 36 in its lower part. The bellows 34 must be capable of withstanding temperatures of the order of 300° to 400° C., in continuous operation. It is made for example of glass fibres impregnated with a fluorocarbon polymer.

The flanges and counter-flange members 19, 20 and 27, 30 have holes for passing bolts therethrough, so as to maintain the cohesion of the assembly. Free rotary movement of the assembly is ensured by a thick high temperature lubricant (grease) which is injected into the space between the flanges by way of greasers 21 and 22. The intermediate element 16 further comprises an operating device formed by a double link-crank system which makes it possible at the same time to provide for alignment of the axes 8 and 12 on Y, that is to say along the transverse axis of the furnace, while maintaining or restoring the alignment on X. When the axes are aligned along X and Y, the same device makes it possible to lower the lower element 17 until it comes into contact with the taphole 8 (alignment on Z). The operating device which is of a symmetrical configuration with respect to a plane passing through the axis 28 comprises a shaft 38 which passes diametrally through the element 16A and which at its two ends supports a disc 37A and 37B provided with a radial operating handle 38A and 38B and is connected by a pivotal connection 43A and 43B which is not coincident with the shaft 38, to the upper end of a strut 40A and 40B, the lower end of which has a pivot connection 39A and 39B fixed to the lower element 17.

Figure 6:
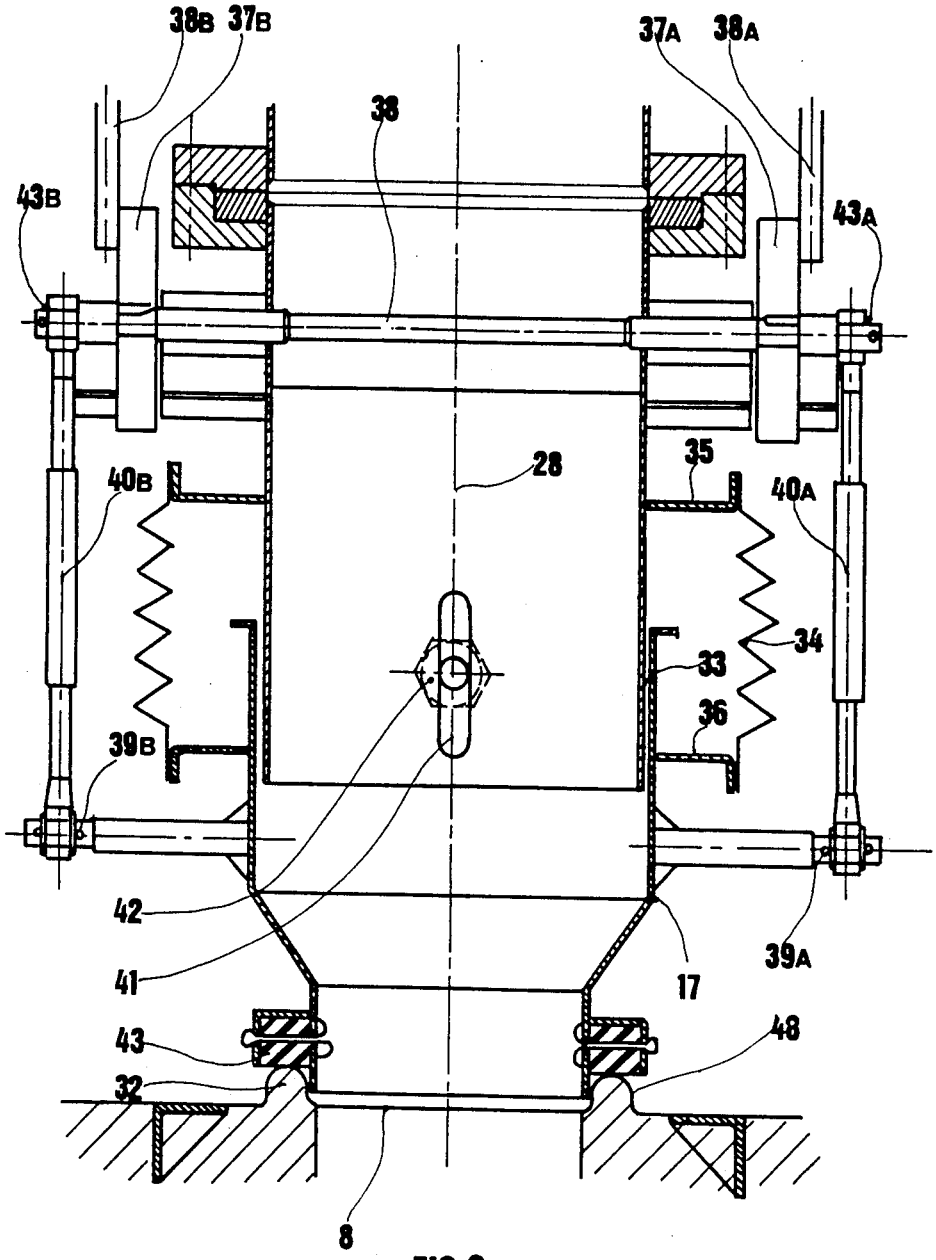
FIG. 6 is a view in section in FIG. 3 in a plane perpendicular to the plane thereof.

Details of the system can be seen from FIG. 6 which is a view in section through FIG. 3 through the shaft 38 and in a plane perpendicular to FIG. 3.

The mode of operation of the arrangement according to the invention is as follows: the lower element 17 being raised to the maximum extent, the suction pipe is set in position and the operator marks any differences between the axis 13 of each taphole and the axis 12 of the lower element 17. The axis 12 may moreover be embodied by a rigid metal rod supported by three bracer members.

By operating the handles 31, the operator effects alignment of the axes 13 and 12 along X, that is to say along the long axis of the furnace; then, by operating the handles 38A and 38B, he aligns the axes 13 and 12 in respect of Y, that is to say along the transverse axis of the furnace, while maintaining or restoring the alignment on X. At that moment, the axes 13 and 12 being aligned, all that remains to do is to effect adjustment along the axis Z, that is to say, lower the lower element 17 until it comes into contact with the groove of the taphole 8.

The last operation is also effected by means of the handles 38A and 38B but on this occasion by rotation about the shaft 38. The lower element 17 is guided for alignment thereof along the axis Z (upward or downward movement) by means of an oblong hole 41 provided in the element 16, in which a lug 42 fixed with respect to the element 17 is slidable.

That sequence of operations, which is quick and easy, will be repeated on the 6 or 7 nipples of the suction pipe, which will thus be perfectly fitted to the 6 or 7 tapholes of the chamber or the separating wall in question.

Figure 4:
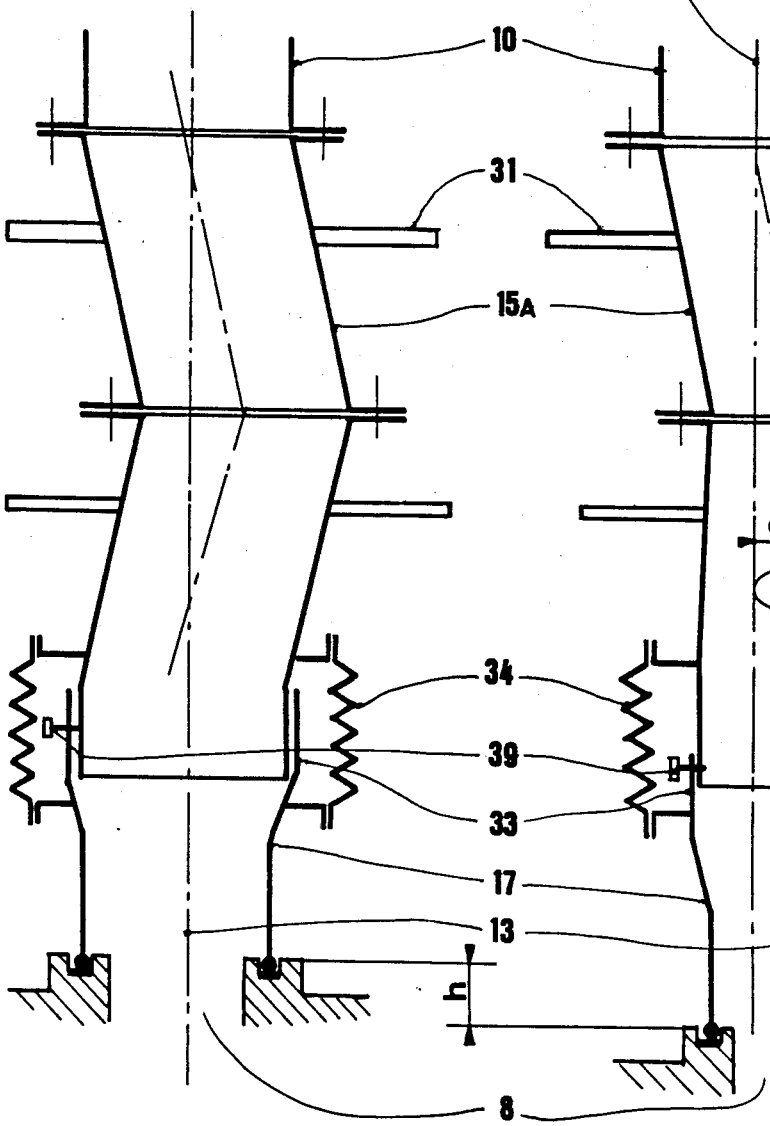
FIGS. 4 and 5 show an alternative embodiment of the invention.
Figure 5:
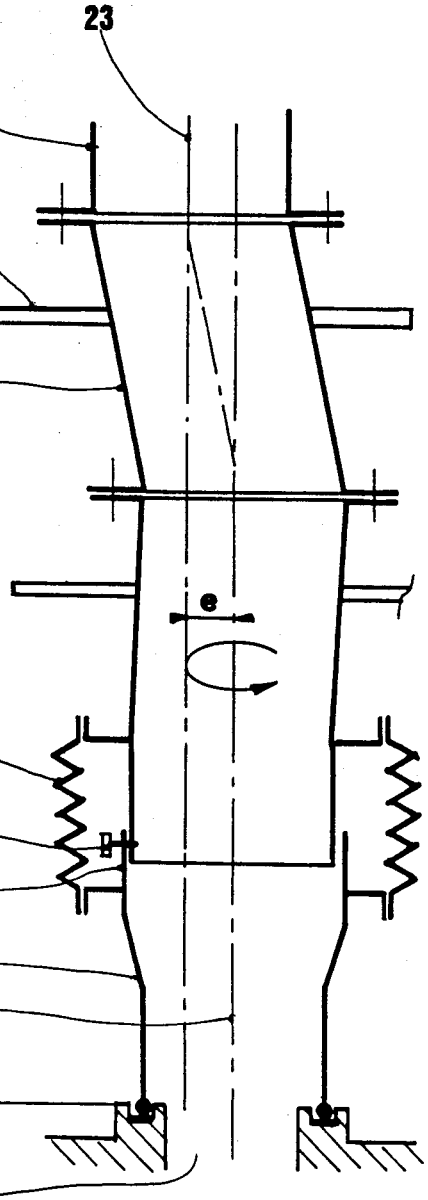

It may be noted that the structure of the upper and intermediate elements 15 and 16 could be simplified, as indicated in FIGS. 4 and 5, by partially or totally eliminating the cylindrical parts which have a vertical axis, and retaining only the central parts 15A and 16A with their axis inclined at an angle α.

In FIG. 5, the element 16A has been turned through an angle in such a way as to compensate for the difference "e" on the axis Y between the axis 13 of the taphole and the axis 23 of the nozzle 10.

It will also be noted that the difference in height h of the taphole is taken up on the axis Z, by operating at the sliding junction 33. The difference between the sliding junction 33 and the intermediate element 16 makes it possible to compensate for any lack of planarity of the taphole.

In the construction shown in FIGS. 4 and 5, the reference of the axes 23, 24, 24A, 25 and 28 will be in relation to the planes of the connecting flanges 18, 19, 26, 27, since there is no longer any cylindrical part. That reference still remains applicable in the case of the structure shown in FIG. 3. The plane of the flanges is normally horizontal.

Moreover, the invention is not limited to the embodiment of the connecting flanges between the elements 10, 15 and 15, 16 or the connection between 16 and 17. Any equivalent means which makes it possible to provide a rotary movement while maintaining a sealed junction and adjustment in respect of height while also maintaing a sealed junction is part of the invention.

Finally, the angle $\alpha$ may be determined by virtue of the situation of use on the basis of straightforward geometrical considerations, considering on the one hand the height of the inclined-axis part of the nipple and the difference in eccentricity to be absorbed (of the order of 50 mm and more if necessary). The height of the inclined part of an element 15 or 16 being for example 90 mm, that will give tan $\alpha=50/90$, hence $\alpha=29°$.

ADVANTAGES OBTAINED BY THE INVENTION

Apart from the ease of alignment of X and Y of the axes of the nipples with the axes of each of the tapholes, it should be emphasized that, by raising the lower element 17 to the maximum extent in the assembly operation, adjustment on Z (in respect of height) makes it possible to avoid abrupt contact occurring between the lower part of the nipples and the respective tapholes when the pipe is set in place by means of a travelling crane, thus avoiding any risk of damaging the tapholes and even the masonry structure.

The arrangement which makes it possible simultaneously to lower the lower part of the nipple and to provide for rotary movement thereof enhances the ease and accuracy of the manipulation operation and thus guarantees the best possible sealed relationship in the connections of the intake or blowing pipes, to the tapholes.

What is claimed is:

1. In a suction or blowing pipe for a furnace having partitioned chambers intended for the firing of carbonaceous blocks, said pipe comprising a main body (3) provided with a plurality of nozzles (10) to which tubular nipples (2) are connected in a number equal to the number of partitions (5) forming the chambers of the furnace, each said nipple being connected to a transverse furnace wall (9) or partition (5) by a taphole (8) disposed in the upper part of the wall or partition, the improvement comprising forming each nipple by at least two tubular elements disposed in series, a first element (15) provided in its upper part (15A) with a first flat flange (18), adapted to cooperate in jointed relationship and in respect of rotation with a flat flange (19) located in the lower part of a nozzle (10), and in its lower part (15C) with a second flat flange (27) which is parallel to the first flat flange (18), and a second element (16) provided in its upper part (16A) with a third flat flange (26), which cooperates in jointed relationship and in respect of rotation with said second flat flange (27), said first and second elements having over at least a part of their height an axis inclined by an angle $\alpha$ with respect to the axis (23) which is perpendicular to the plane of the flanges, whereby a sealed joint is produced between each nipple and its corresponding taphole by alignment along the long and short axes of the furnace despite deformation of the chambers.

2. A pipe according to claim 1, wherein each nipple further comprises a third tubular element (17) in jointed relationship by substantially coaxial sliding partial interengagement (33) with the lower part (16C) of the second element (16), the lower part of said third element fitting in sealing relationship to the taphole (8).

3. A pipe according to claim 1, wherein the first element (15) and/or the second element (16) comprises at least one first cylindrical part with its axis perpendicular to the plane of the flanges and a second cylindrical part at an angle $\alpha$ to the axis of the first cylindrical part.

4. A pipe according to claim 3, wherein the angle $\alpha$ is determined by its tangent which is equal to the ratio of the maximum eccentricity to be compensated, to the height of the inclined part of the element in question.

5. A pipe according to claim 2, wherein the sliding joint (33) between the second element (16) and the third element (17) is covered by a sealing bellows (34) which can withstand high temperature.

6. A pipe according to claim 1, wherein said flanges (18, 19, 26, 27) are provided with a sealing means.

7. A pipe according to claim 1, wherein the connecting flanges (18, 19, 26, 27) are supported by counterflange members (20, 30) respectively and are provided with removable clamping means.

8. A pipe according to claim 6, wherein the sealing relationship between the flanges (18, 19, 26, 27) is produced by injection into greasers (21, 22) of a thick grease which is capable of withstanding high temperature.

9. A pipe according to claim 6, wherein the sealing relationship between the flanges (18, 19, 26, 27) is produced by a metalloplastic seal.

10. A pipe according to claim 1, 2, 3, 6 or 7, wherein the first element (15) is provided with operating handles (31) for producing axial rotation thereof.

11. A pipe according to claim 2 or 5, wherein, in order to provide both for alignment of the elements (16 and 17), the upper part (16A) of the second element (16) comprises a device for adjustment thereof in respect of rotation and height, formed symmetrically with respect to the plane passing through the axis (28) of the lower part (16C) of said second element, and which comprises a shaft (38) which passes diametrically through the upper part (16A) of said second element and which supports at each of its two ends a disc (37A, 37B), each disc being provided with a radial operating handle (38A, 38B) and connected by a pivotal connection (43A, 43B) which is not coincident with the shaft (38) to the upper end of a strut (40A, 40B) whose lower end is connected by a pivotal connection (39A, 39B) which is fixed to the third element (17).

12. A pipe according to claim 7, wherein said clamping means comprises bolts.

* * * * *